US009119466B2

(12) United States Patent
Parshad

(10) Patent No.: US 9,119,466 B2
(45) Date of Patent: Sep. 1, 2015

(54) TABLE LEG ASSEMBLY

(71) Applicant: Inscape Corporation, Holland Landing (CA)

(72) Inventor: David Parshad, Markham (CA)

(73) Assignee: Inscape Corporation, Holland Landing, Ontario (CA)

( * ) Notice: Subject to any disclaimer, the term of this patent is extended or adjusted under 35 U.S.C. 154(b) by 166 days.

(21) Appl. No.: 13/834,489

(22) Filed: Mar. 15, 2013

(65) Prior Publication Data

US 2014/0261094 A1 Sep. 18, 2014

(51) Int. Cl.

| | |
|---|---|
| ***A47B 17/00*** | (2006.01) |
| ***A47B 19/00*** | (2006.01) |
| ***A47B 27/00*** | (2006.01) |
| ***A47B 41/00*** | (2006.01) |
| ***A47B 13/06*** | (2006.01) |
| *A47B 21/06* | (2006.01) |

(52) U.S. Cl.

CPC ..... *A47B 17/00* (2013.01); *A47B 13/06* (2013.01); *A47B 21/06* (2013.01); *A47B 2200/0085* (2013.01); *A47B 2200/12* (2013.01)

(58) Field of Classification Search

CPC ..... A47B 17/033; A47B 17/03; A47B 13/02; A47B 2200/0011; A47B 2200/0014; A47B 2200/002; A47B 2200/0026; A47B 2200/0027; A47B 2200/07; A47B 21/06; E04B 2002/7462; E04B 2/7407

USPC ..... 108/28, 185, 187, 193; 312/331.3, 312/351.4, 351.5, 351.8, 265.6, 265.3, 194, 312/195

See application file for complete search history.

(56) References Cited

U.S. PATENT DOCUMENTS

| | | | | |
|---|---|---|---|---|
| 3,216,170 | A | 11/1965 | Deadrick | |
| 3,666,339 | A | 5/1972 | Neufeld | |
| 4,066,305 | A * | 1/1978 | Gazarek | 312/195 |
| 5,035,470 | A * | 7/1991 | Miller | 312/195 |
| 5,224,610 | A * | 7/1993 | Veazey | 211/87.01 |
| 5,546,873 | A * | 8/1996 | Conner et al. | 108/90 |
| 6,705,235 | B1 | 3/2004 | Gerutto | |
| 6,712,433 | B2 | 3/2004 | Hellwig | |
| D583,176 | S | 12/2008 | Bochner et al. | |
| D641,186 | S | 7/2011 | Martin et al. | |
| D649,810 | S | 12/2011 | Martin et al. | |
| D649,811 | S | 12/2011 | Martin et al. | |
| D650,614 | S | 12/2011 | Martin et al. | |
| D651,430 | S | 1/2012 | Martin et al. | |
| D658,910 | S | 5/2012 | Kapp | |
| D662,336 | S | 6/2012 | Martin et al. | |
| D662,731 | S | 7/2012 | Martin et al. | |
| 2002/0129746 | A1 * | 9/2002 | Donnelly | 108/25 |
| 2005/0223952 | A1 | 10/2005 | Brewer et al. | |
| 2007/0101908 | A1 | 5/2007 | Makita | |
| 2009/0051254 | A1 | 2/2009 | Grove | |
| 2011/0297051 | A1 | 12/2011 | Martin et al. | |
| 2011/0297052 | A1 | 12/2011 | Martin et al. | |
| 2011/0297053 | A1 | 12/2011 | Martin et al. | |
| 2011/0297056 | A1 | 12/2011 | Martin et al. | |
| 2012/0037049 | A1 | 2/2012 | Martin et al. | |

FOREIGN PATENT DOCUMENTS

| | | |
|---|---|---|
| FR | 2705758 | 2/1994 |

* cited by examiner

*Primary Examiner* — Daniel Rohrhoff
*Assistant Examiner* — Andres F Gallego
(74) *Attorney, Agent, or Firm* — Riches, McKenzie & Herbert LLP

(57) ABSTRACT

A table leg assembly with an intermediate beam to removably support elements on the table leg assembly.

13 Claims, 18 Drawing Sheets

TABLE LEG ASSEMBLY

SCOPE OF THE INVENTION

This invention relates to table leg assemblies and, more particularly, to table leg assemblies with a horizontal beam extending between two vertical legs.

BACKGROUND OF THE INVENTION

Various table leg assemblies are known for supporting a worksurface of a table.

The present inventor has appreciated that previously known table leg assemblies fail to provide a simpler convenient manner for coupling of various functional elements to the table.

SUMMARY OF THE INVENTION

To at least partially overcome disadvantages of previously known table leg assemblies, the present invention provides a table leg assembly with an intermediate beam to removably support elements on the table leg assembly.

In one aspect, the present invention provides a table having a tabletop worksurface, the worksurface having a downwardly directed lower surface, a leg structure supporting the tabletop under an end of the table, the leg structure having two spaced vertical legs, each leg having a top and a bottom, each leg top disposed below the lower surface, each leg having an outer end surface, the outer surfaces of both legs lying in a common flat outer end plane, an elongate horizontal intermediate beam extending between the legs intermediate the top and bottom of the legs, the intermediate beam having two ends each end joined to one of the legs, the intermediate beam spaced below the lower surface of the worksurface forming a vertical space therebetween, the intermediate beam having an outer side surface, the outer side surface of the intermediate beam disposed inwardly of the outer end plane.

In another aspect, the present invention provides a table having a tabletop worksurface the table having an outer end, a leg structure supporting the tabletop under the end of the table, the leg structure having two spaced vertical legs comprising a right leg and a left leg, each leg having a top and a bottom, each leg having an outer end surface and an inner end surface, the outer surfaces of both legs lying in a common flat outer end plane, the inner surfaces of both legs lying in a common flat inner end plane parallel to the outer plane, each leg having an interior surface directed toward the other leg, an elongate horizontal upper beam extending between the legs proximate the top of the legs, the upper beam having two ends with each end joined to one of the legs, the upper beam having a bottom surface directed downwardly, an elongate horizontal intermediate beam extending between the legs intermediate the top and bottom of the legs, the intermediate beam having two ends with each end joined to one of the legs, the intermediate beam spaced below the upper beam forming a vertical space therebetween, the intermediate beam having an outer side surface and an inner side surface, the intermediate beam having a top surface, the outer side surface of the intermediate beam disposed inwardly of the outer end plane, a rectangular flat planar privacy panel having an outer face and an inner face joined by a top edge, a bottom edge, a right side edge, and a left side edge, the privacy panel disposed between the outer end plane and the inner end plane outwardly of the intermediate beam with the outer face of the panel directed away from the intermediate beam, the top edge below the upper beam, the right side edge adjacent the interior surfaces of a first of the legs and the left side edge adjacent the interior surfaces of a second of the legs, the panel mounted to the intermediate beam outwardly of the beam by a hook member removably mounted to the intermediate beam and extending rearwardly over the top surface of the intermediate beam and downwardly into engagement with the inner side surface of the intermediate beam.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
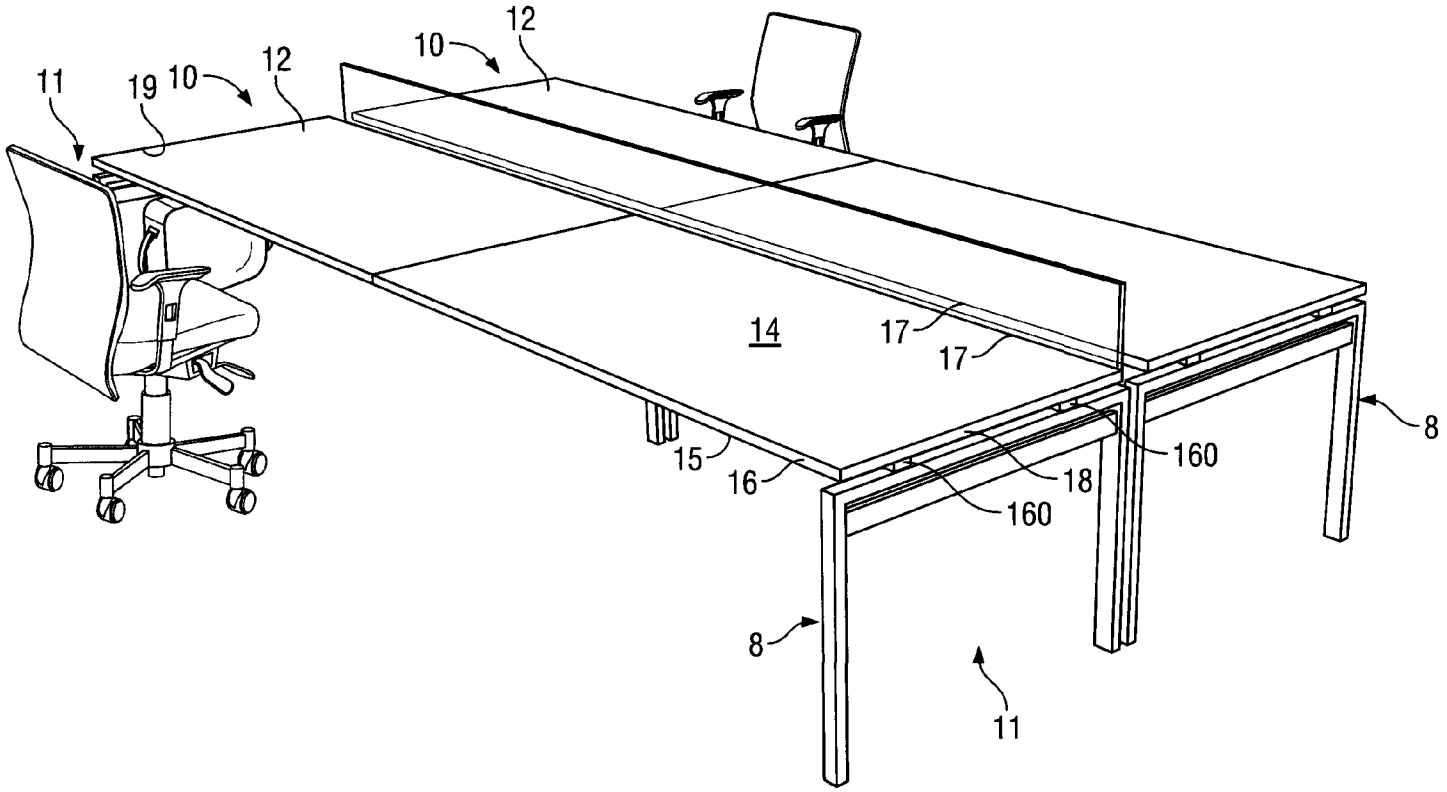
FIG. 1 is a pictorial view illustrating tables with leg assemblies in according with a first embodiment of the present invention.

FIG. 1 shows two tables 10. Each table 10 has a worksurface 12 which is supported at each end 11 of the table by leg structures 8. The worksurface 12 has an upper surface 14, a lower surface 15, a front 16, a rear 17, a right end 18 and a left end 19.

Figure 3:
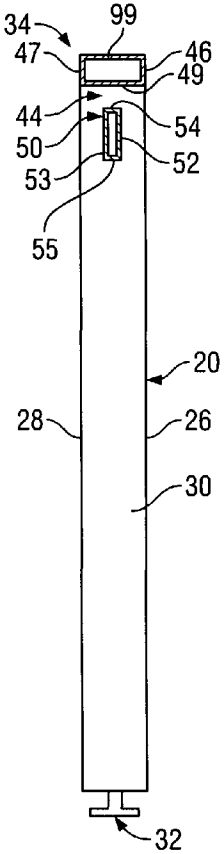
FIG. 3 is a cross-sectional front view of the leg assembly of FIG. 2 along section line A-A' in FIG. 2.
Figure 2:
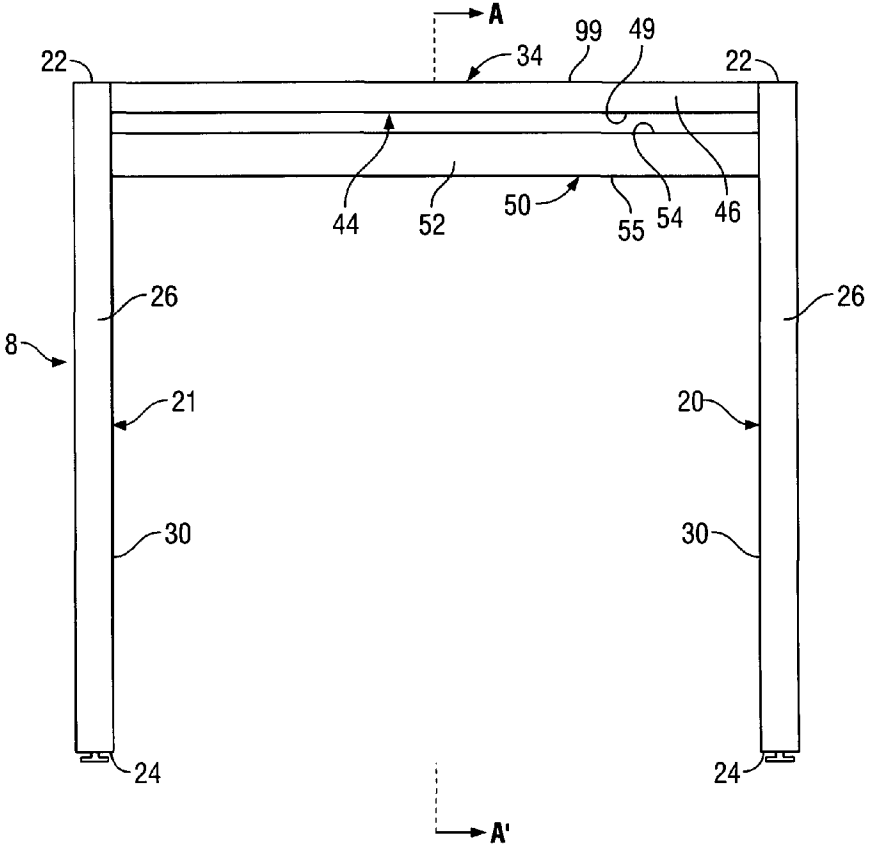
FIG. 2 is an end view of the leg structure shown on one table in FIG. 1.

The leg structure 8 is best seen in FIGS. 2 and 3 and includes a right leg 20 and a left leg 21, each having a top 22 and a bottom 24. Each of an upper beam 34 and an intermediate beam 50 extend between the right leg 20 and the left leg 21.

The right leg 20 and the left leg 21 are identical and mirror images of each other. Each of the legs has an outer end surface 26, an inner end surface 28 and an interior surface 30. A foot 32 is secured to the bottom 24 of each leg to support the leg on a floor surface.

Figure 8:
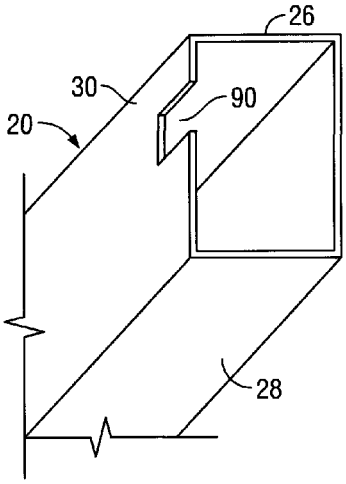
FIG. 8 is a bottom pictorial view of a bottom end of the leg shown in FIG. 5.

As can be seen in the bottom view of FIG. 8, each leg has a rectangular profile.

The upper beam 34 similarly has a rectangular profile with an outer surface 46, an inner surface 47, a bottom surface 49 and a top surface 99. The outer end surface 26 of the right leg 20 and of the left leg 21 lies in a flat common outer end plane. The outer surface 46 of the upper beam 34 also lies in this same common flat outer end plane. The inner end surface 28 of each of the right leg 20 and left leg 21, lie in a common flat inner end plane which is parallel to the outer end plane. The inner surface 47 of the upper beam 34 also lies in the inner end plane.

The intermediate beam 50 has a first end rigidly coupled to the right leg 20 and a second end rigidly coupled to the left leg 21. The intermediate beam 50 is also rectangular in cross-section as best seen in FIG. 3 with an outer surface 52, an inner surface 53, a top surface 54 and a bottom surface 55. Each of the upper beam 34 and the intermediate beam 50 extend horizontally between the legs 20 and 21. The intermediate beam 50 is proximate to the upper beam 34, however, is spaced vertically below the upper beam 34 so as to provide a vertical space 44 between the top surface 54 of the intermediate beam and the bottom surface 49 of the upper beam 34. The outer surface 53 of the intermediate beam 50 is disposed inwardly from the flat outer end plane within which the outer end surfaces 26 of the legs 20 and 21 lie. Similarly, the inner surface 52 of the intermediate beam 50 is outwardly of the inner end plane in which the inner end surfaces 28 of the legs 20 and 21 lie.

In the leg structure 8, as seen in FIG. 2, the inclusion of the upper beam 34 and the intermediate beam 50 provides increased strength to the leg assembly 20 as contrasted with the leg assembly in which merely one of the beams is provided. The location of the intermediate beam 50 proximate to the upper beam 34 provides a pleasing aesthetic.

Figure 4:
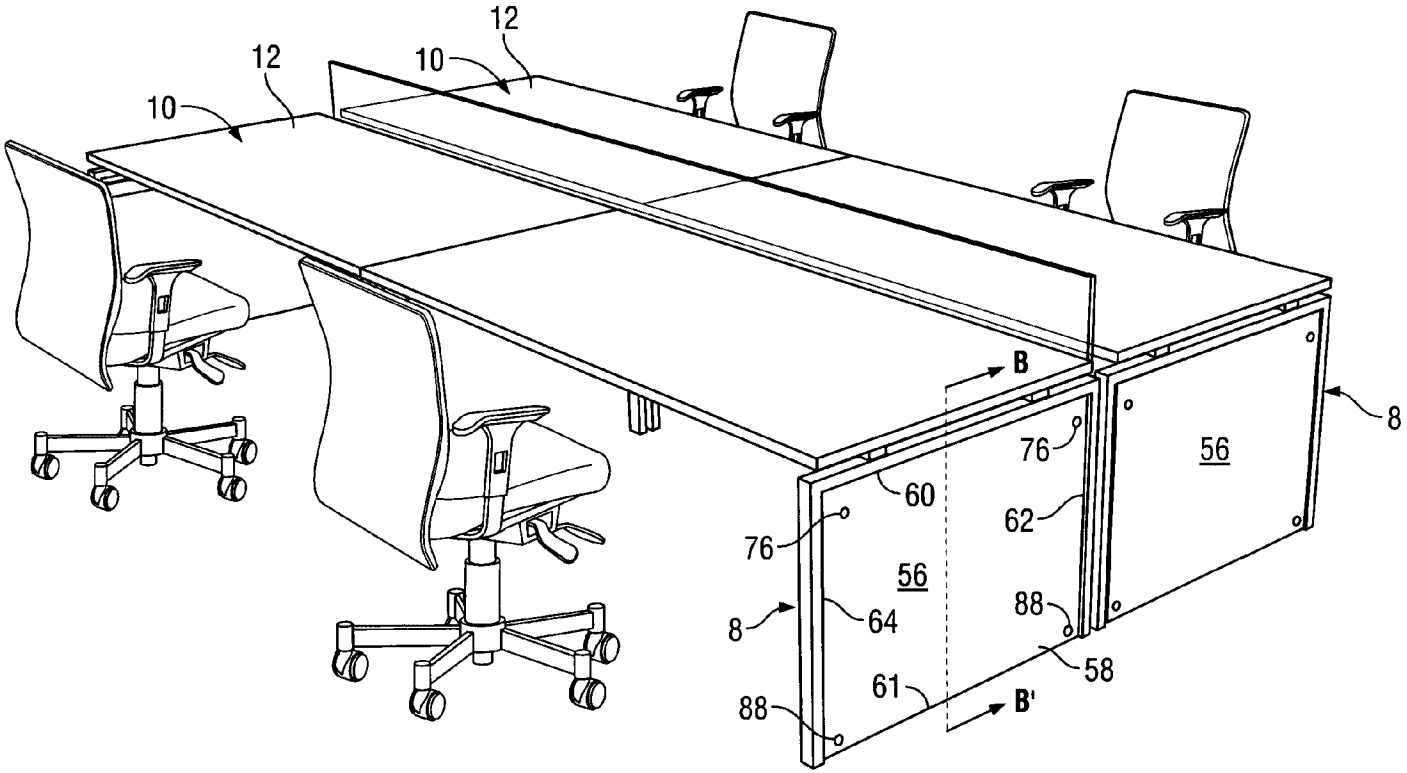
FIG. 4 is a pictorial view of the tables of FIG. 1 with two privacy panels attached to the end of two legs.
Figure 5:
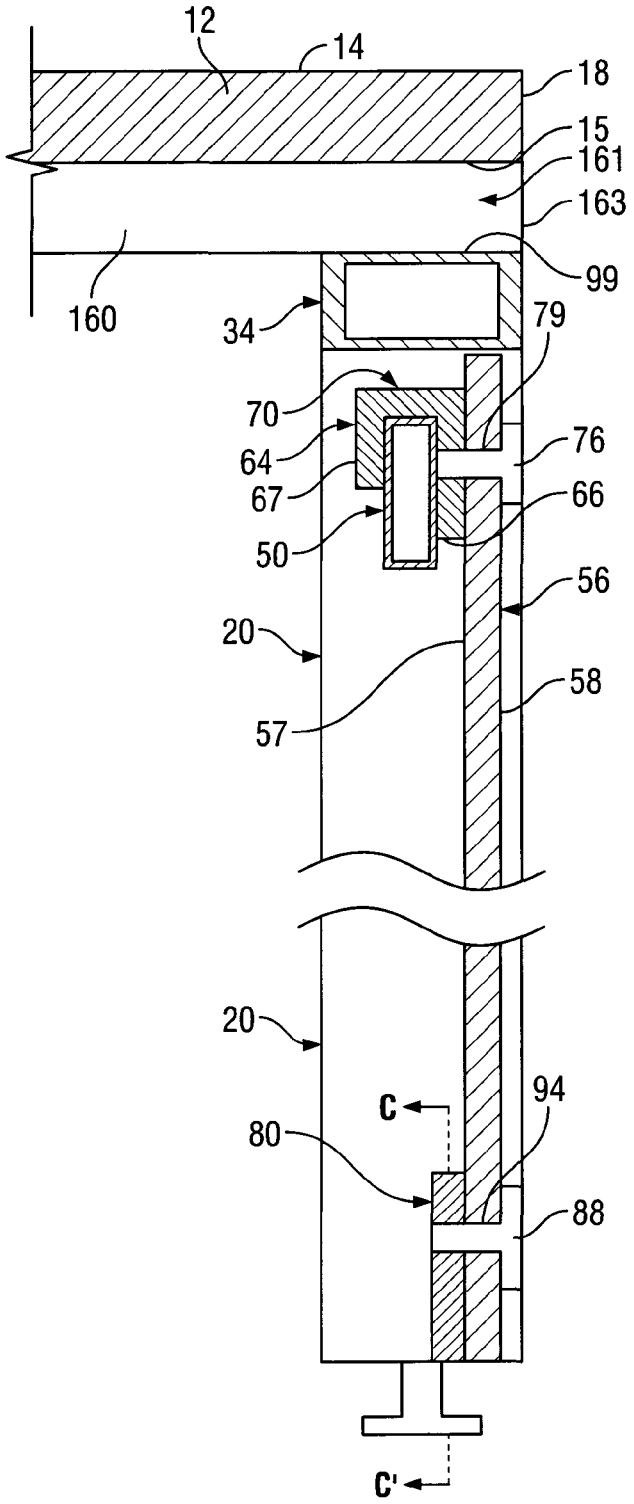
FIG. 5 is a cross-sectional front view along section line B-B' in FIG. 4.
Figure 6:
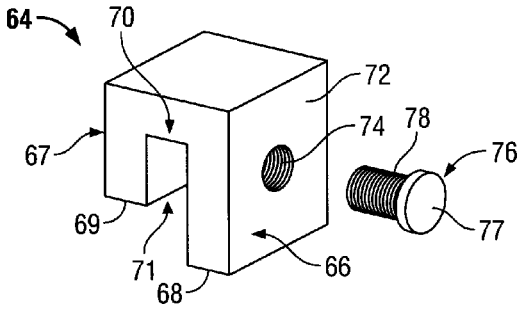
FIG. 6 is a pictorial view of a hook member and fastener shown in FIG. 5.

Reference is made to FIG. 4 which illustrates the identical tables 10 and leg structures 8 in FIG. 1, however, with a privacy panel 56 attached to each leg structure 8. As can best be seen in FIG. 5, the privacy panel 56 has an outer face 58 and an inner face 57 which are joined by a top edge 60 and a bottom edge 61, a right edge 62 and a left edge 64. A hook member 64 is removably engaged on the intermediate beam 50. The hook member 64, as best seen in FIG. 6, includes an outer arm 66 and an inner arm 67 joined by a bight member 70. The outer arm 66 extends from the bight member 70 to a distal end 69. The inner arm 67 extends from the bight member 70 to a distal end 69. A slotway 71 is formed between the outer arm 66 and the inner arm 67. The outer arm 66 has an outer surface 72. A threaded bore 74 extends into the outer arm 66. A threaded fastener 76 is provided having an enlarged head 77 and a threaded shank 78 which is adapted to be threadably engaged within the bore 74. As seen in FIG. 5, the panel 56 has an upper opening 79 therethrough through which the fastener 76 extends so as to secure the panel 56 to the outer arm 66 of the hook member 64 with the inner face 57 of the panel 56 in engagement with the outer surface 72 of the outer arm 66 of the hook member 64.

Figure 7:
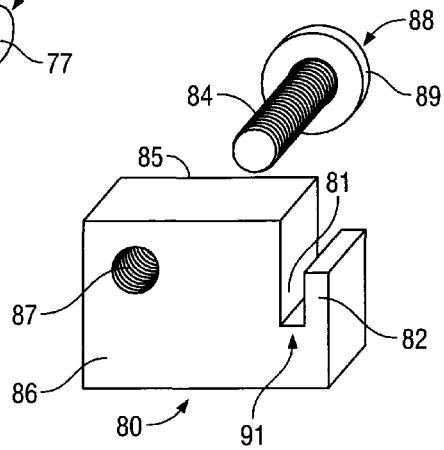
FIG. 7 is a pictorial view of a bracket member and fastener of FIG. 5.

FIGS. 5 and 7 show a bracket member 80 to engage the right leg 20 at the bottom 24 of the leg 20 to couple the panel 56 to the leg 20. An identical bracket member 80 is used to secure the panel member to the left leg 21 in a mirror image fashion. Bracket member 80 is formed as a plate member of constant thickness between an outer surface 85 and an inner surface 86. A vertically extending slotway 81 is cut into the bracket member 80 so as to define an upwardly extending arm 82. A threaded bore 87 extends through the bracket member spaced from the slotway 81 away from the arm 82. A fastener 88 is provided with an enlarged head 89 and a threaded shank 84 to be received within the bore 87. Referring to FIG. 8, at the bottom of the right leg 20, a notch 90 is cut out from the interior surface 30 of the leg. The notch 90 has a width corresponding to the width between the outer surface 85 and the inner surface 86 of the bracket member 80.

Figure 9:
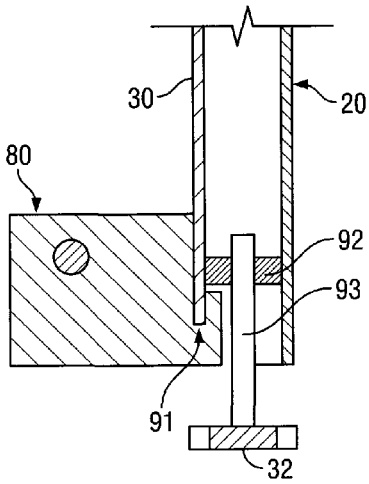
FIG. 9 is a cross-sectional view along section line C-C' in FIG. 5.

Referring to FIG. 9, the bracket member 80 is engaged on the leg 20 with the interior surface 30 being received within the slotway 71 and a portion 91 of the bracket member 80 below the slotway 81 extending horizontally through the slot 90. In this manner, the bracket member 80 can be secured to the leg 20 so as to not extend below the bottom of the leg 20 yet with the bracket member 80 engaging the leg 20 to fixedly extend perpendicular to the interior surface 30. As schematically shown in FIG. 9, the bracket member 80 does not interfere with the engagement of a threaded shank 93 carried on the foot 32 being threadably received within a plate 92 fixed inside the leg 20 having a threaded bore and providing a mechanism for height adjusting the leg 20.

Referring to FIG. 5, with the bracket member 80 engaged on the right leg 20, as seen in FIG. 9, the fastener 88 extends through a lower right opening 94 in the panel 56 to urge the inner face 57 of the panel 56 into engagement with the outer surface 85 of the bracket member 80. As can be seen in FIG. 5, the outer face 58 of the panel is disposed to be parallel to the outer end plane containing the outer end surfaces 26 of the legs 20 and 21. The outer face 58 of the panel is shown as being recessed inwardly from the outer end surfaces 26. This is preferred but not necessary. Preferably, the outer face 58 does not extend outwardly beyond the outer end plane formed by the outer end surfaces 26 as is advantageous such that the edges of the panel 56, namely, the top edge 60, the right edge 62 and the left edge 63 are not readily visible and need not be finished. Preferably, the top edge 60, right edge 62 and left edge 63 are located close to the respective intermediate beam 50, right leg 20 and left leg 21 such that they cannot easily be seen.

As can be seen in FIG. 4, each of the upper fasteners 76 and lower fasteners 88 is symmetrically located vertically and horizontally to provide a pleasing aesthetic appearance. Preferably, the heads of the fasteners 76 and 88 do not extend outwardly beyond the outer end plane formed by the outer end surfaces 26 of the legs. In the embodiment illustrated in FIG. 5, the hook member 64 by reason of its bight member 70 engaging the top surface 54 of the intermediate beam 50 substantially bears the vertical component of the weight of the panel 56. The bracket member 80 principally provides for relative location of bottom portions of the panel 56 in a correct vertical plane. With the panel 56 held against vertical movement by the hook member 64, the panel member 56 via the lower fastener 88 engages the bracket member 80 in a manner to prevent the bracket member 80 from sliding downwardly out of engagement with the leg 20.

Figure 10:
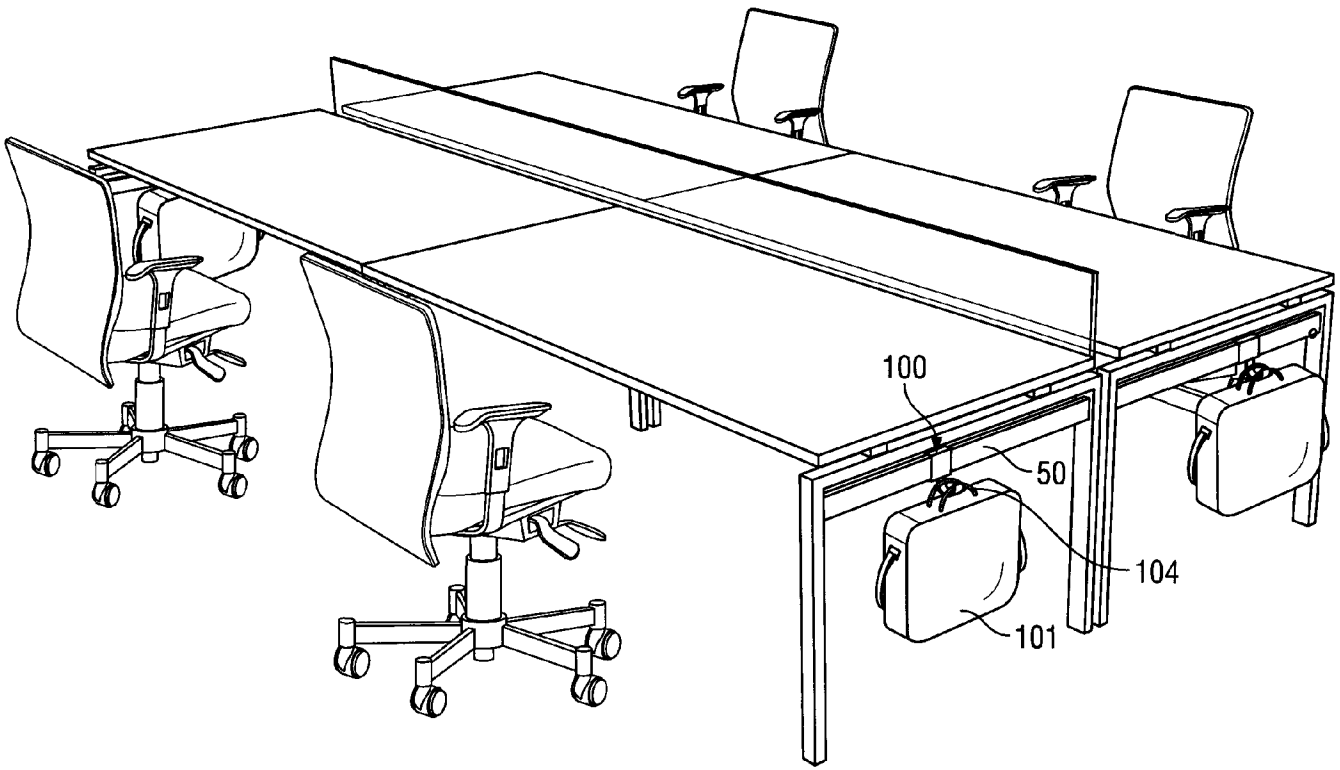
FIG. 10 is a pictorial view of the tables as in FIG. 1 with two hanging hook members secured to the end leg structures and having briefcases mounted thereto.
Figure 11:
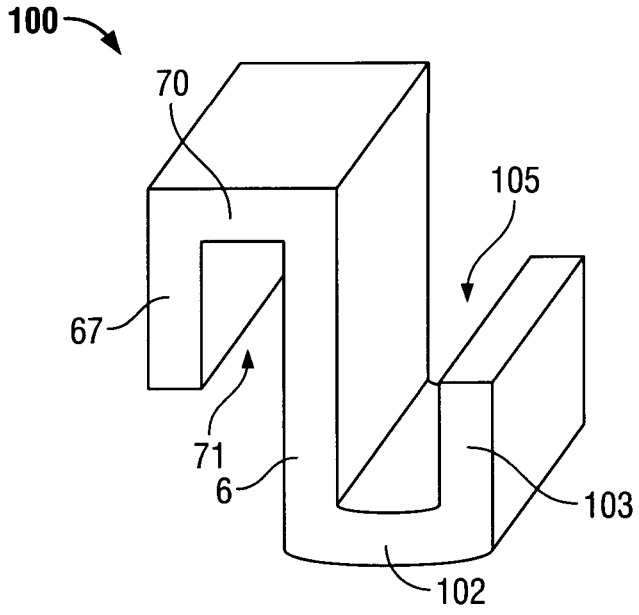
FIG. 11 is a pictorial view of the double hook member of FIG. 10.

FIG. 10 illustrates the tables 10 of FIG. 1 with a double hook member 100 as shown in FIG. 11 engaged on the intermediate beam 50 and with a handled briefcase 101 releasably hung upon the double hook member 100. The double hook member 100 is illustrated in FIG. 11 and is similar to the hook member 64 of FIG. 6 in having an inner arm 67 joined by a bight member 70 to an outer arm 66 to form a slotway 71 between the inner arm 67 and the outer arm 66 within which the intermediate beam member 50 is to be received to support the double hook member 100. The double hook member 100 has the outer arm 66 merge into an outer bight member 102 which merges into an upwardly extending hook prong arm 103. As seen in FIG. 10, a handle 104 of the case 100 is received on the outer bight member 102 in a slotway 105 between the outer arm 66 and the hook prong arm 103. Various other handled bags or cases or articles of clothing, cords, leashes and the like may be hooked upon the double hook member 100 and thus supported by the leg structure 8. The double hook member 100 is slidable longitudinally along the intermediate beam member 50 and thus may be located at desired locations.

Figure 12:
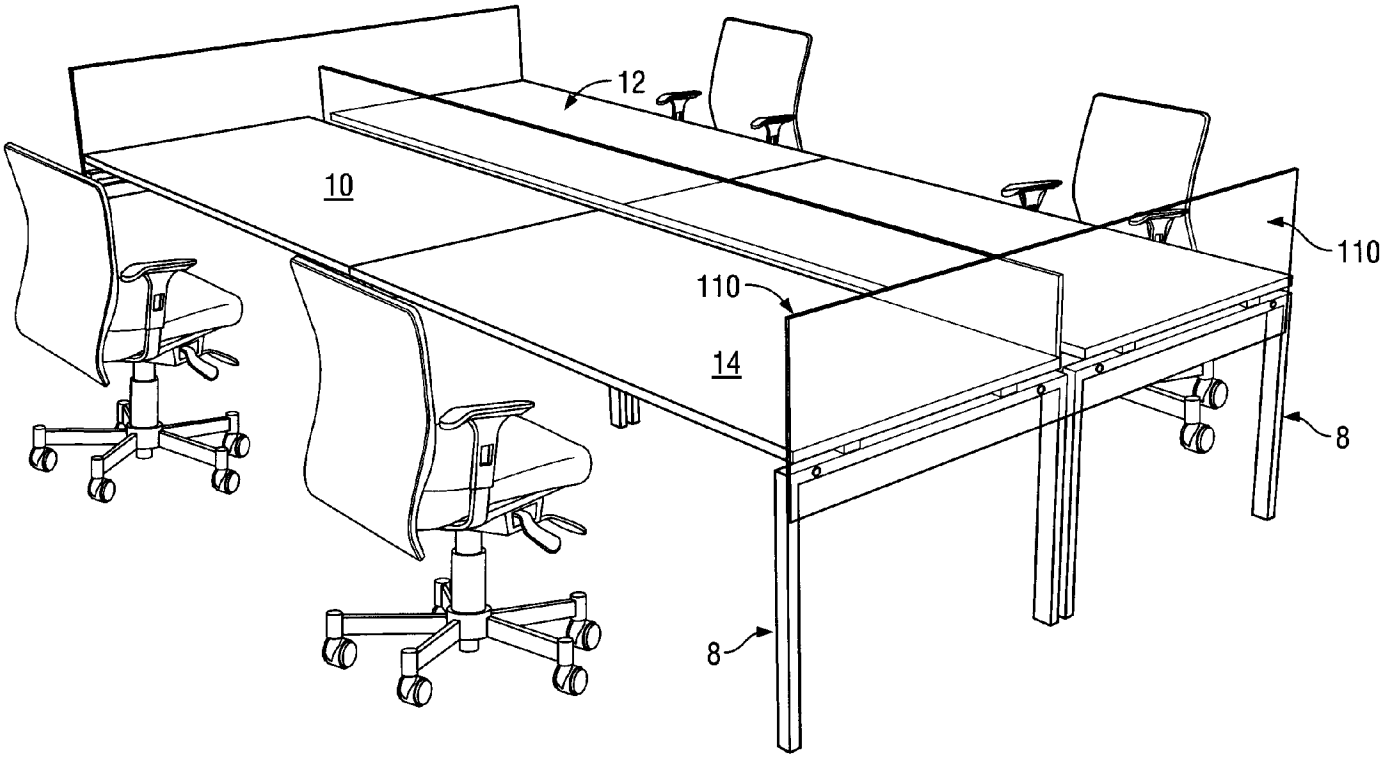
FIG. 12 is a pictorial view of the tables in FIG. 1 with upstanding privacy screens mounted thereon.
Figure 13:
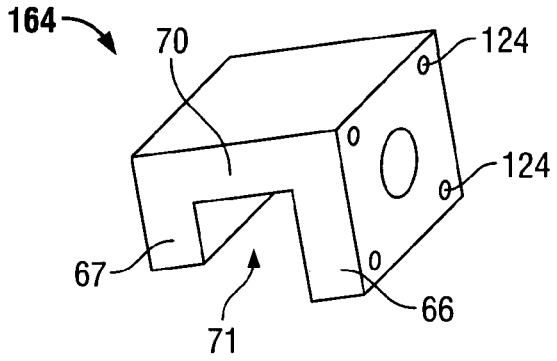
FIG. 13 is a pictorial view of a mounting hook utilized in FIG. 12.
Figure 14:
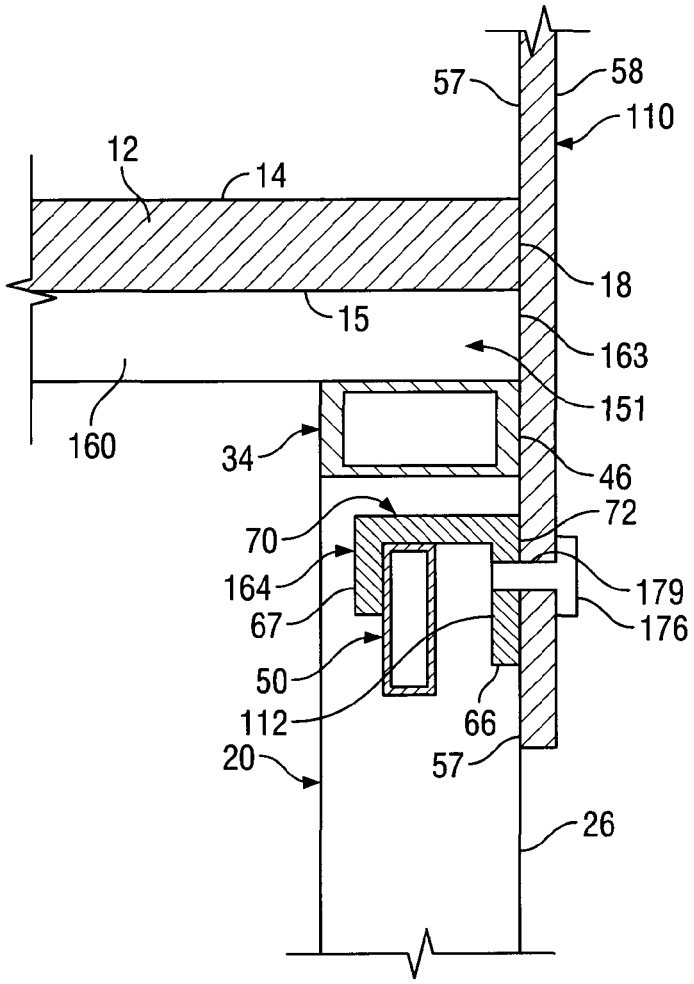
FIG. 14 is a partial cross-sectional front view similar to FIG. 5 of the leg structure and a privacy screen shown in FIG. 12.

Reference is made to FIG. 12 which illustrates the tables 10 as in FIG. 1 on which a privacy screen 110 is removably mounted using a widened form of the hook member 164 as illustrated in FIG. 13. The hook member 164 in FIG. 13 is identical to the hook member 64 shown in FIG. 6 with the exception that the bight member 70 is of increased length so as to provide the slotway 71 between the inner arm 67 and the outer arm 66 to be of increased width. As seen in the partial front cross-section of FIG. 14, a fastener 176 extends through an opening 179 in the privacy screen and into the bore 74 in the hook member 164. The privacy screen 110 has an inner face 57 and an outer face 58. The inner face 57 engages the outer end surface 26 of the legs 20 and 21 so as to dispose the inner face 57 in the outer end plane. The fastener 76 draws the privacy screen 110 into engagement with the outer end surfaces 26 of the leg and the outer surface 46 of the upper beam 34. The hook member 164 engages the intermediate beam 50 with the bight member 70 engaging the top of the intermediate beam to prevent movement of the privacy panel 110 vertically downwardly. As seen, the hook member 164 provides its outer surface 72 to be engaged with the inner face 57 of the privacy screen 110. As an alternate arrangement, in the embodiment of FIG. 13, the outer arm 66 could have a width such that an inner surface 112 of the outer arm 66 is located further inwardly closely adjacent to the outer surface 52 of the intermediate beam 50, that is, to have the slotways 71 of a width substantially corresponding to the width of the intermediate beam 50.

In FIG. 12, the privacy screen 110 is shown to extend between two leg structures 8, that is, across the end of two desks 10. This is not necessary and the privacy screen 110 could merely be provided at the end of one desk 10 as attached to the leg structure 8 for that desk.

Figure 15:
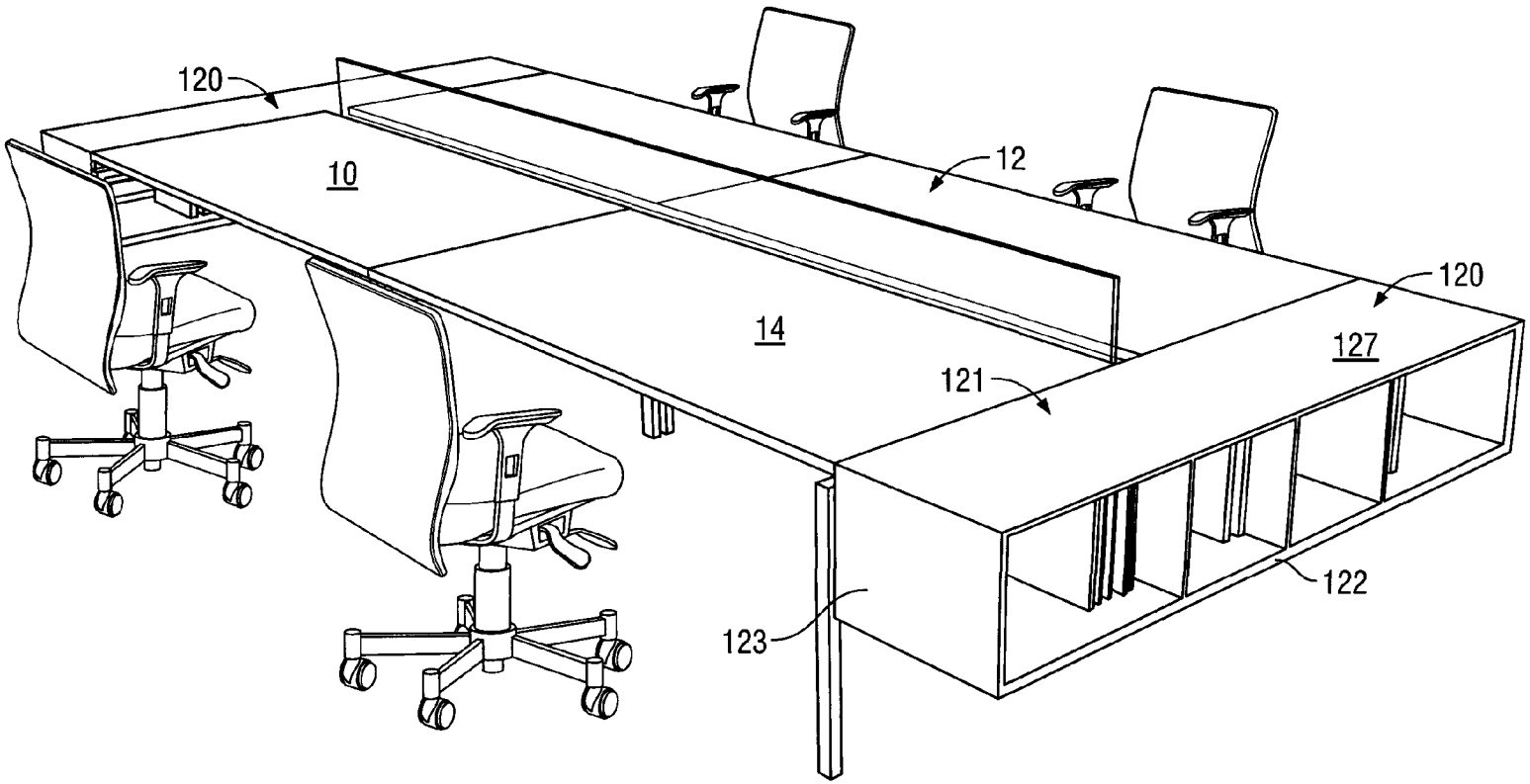
FIG. 15 is a pictorial view of the tables of FIG. 1 with a storage cabinet mounted across the ends of two tables.
Figure 16:
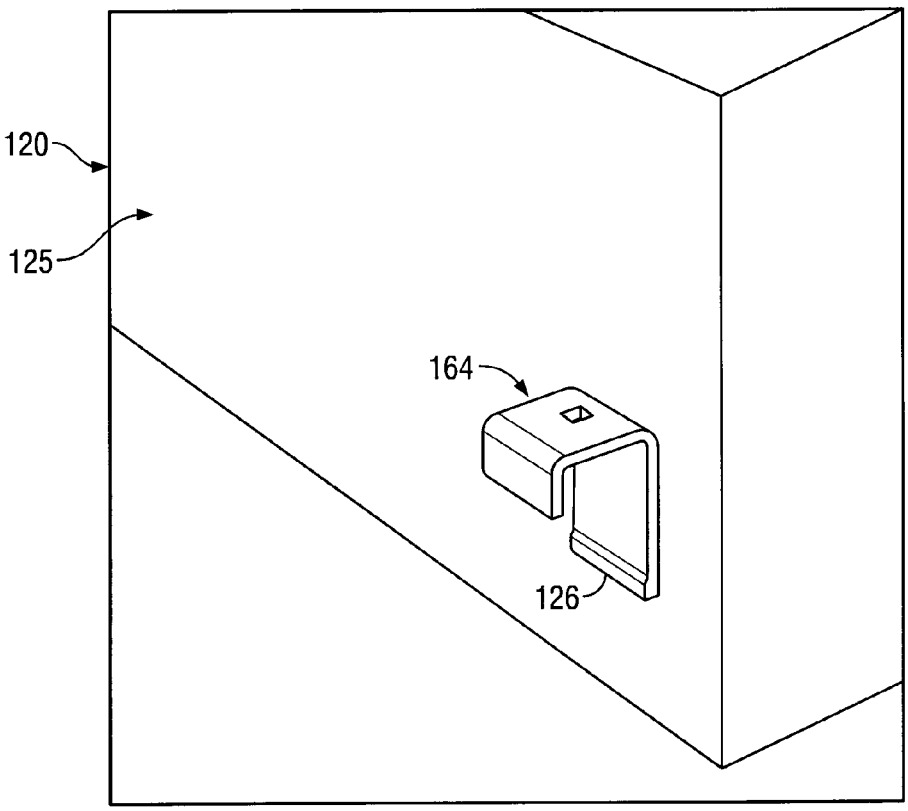
FIG. 16 is a rear view of the storage cabinet of FIG. 15 showing a hook secured thereto.

Reference is made to FIG. 15 showing the tables 10 of FIG. 1 to which two storage cabinets 120 have been attached. Each storage cabinet 120 is formed by a top extension panel 121, a bottom panel 122 and a plurality of vertical panels 123. The cabinet 120 has a rear panel 125 as seen in FIG. 16 to which a hook member 164 identical to the hook member 164 in FIG. 13 has been secured by the use of four fasteners 126 which extend through four small openings 124 in the outer arm 66 and into the rear panel 125 as seen in the partial pictorial view of FIG. 16. As is the case with the manner in which the hook member 164 of FIG. 13 mounts the privacy panel 110 to the leg structures 8 in FIG. 12, in FIG. 15, the rear panel 125 of the cabinet 120 engages the outer surfaces 26 of the legs 20 and 21. With the hook 164 engaged over the intermediate beam 50, the leg structure 8 carries the vertical loading of the cabinet 120. Preferably two such hook members 164 as shown in FIG. 16 are provided to engage the intermediate beam 50 of each leg structure 20. The relative location of the hook members 64 vertically on the rear panel 125 will establish the relative height of a top surface 127 of the top extension panel 121 relative to the upper surface 14 of the worksurface 12 of the table 10. In FIG. 15, the upper surface 127 is horizontal and flush with the upper surface 14 of the worksurface 12 such that the top extension panel 121 forms an end extension of the worksurface 12.

The inner arm 67 of the hook members 164 shown in FIG. 16 has a vertical dimension which is less than the vertical dimension of the space 44 between the upper beam 34 and the intermediate beam 50 such that for ease of attachment and removal of the cabinet 120 in FIG. 15 with the hook member 64 secured to the rear of the cabinet 120, the inner arm 67 of the hook member can be moved horizontally through the space 44 until the inner arm 67 is inwardly of the intermediate beam 50 at which time the cabinet is lowered until the bight member 70 engages the top surface 52 of the intermediate beam 50.

Figure 17:
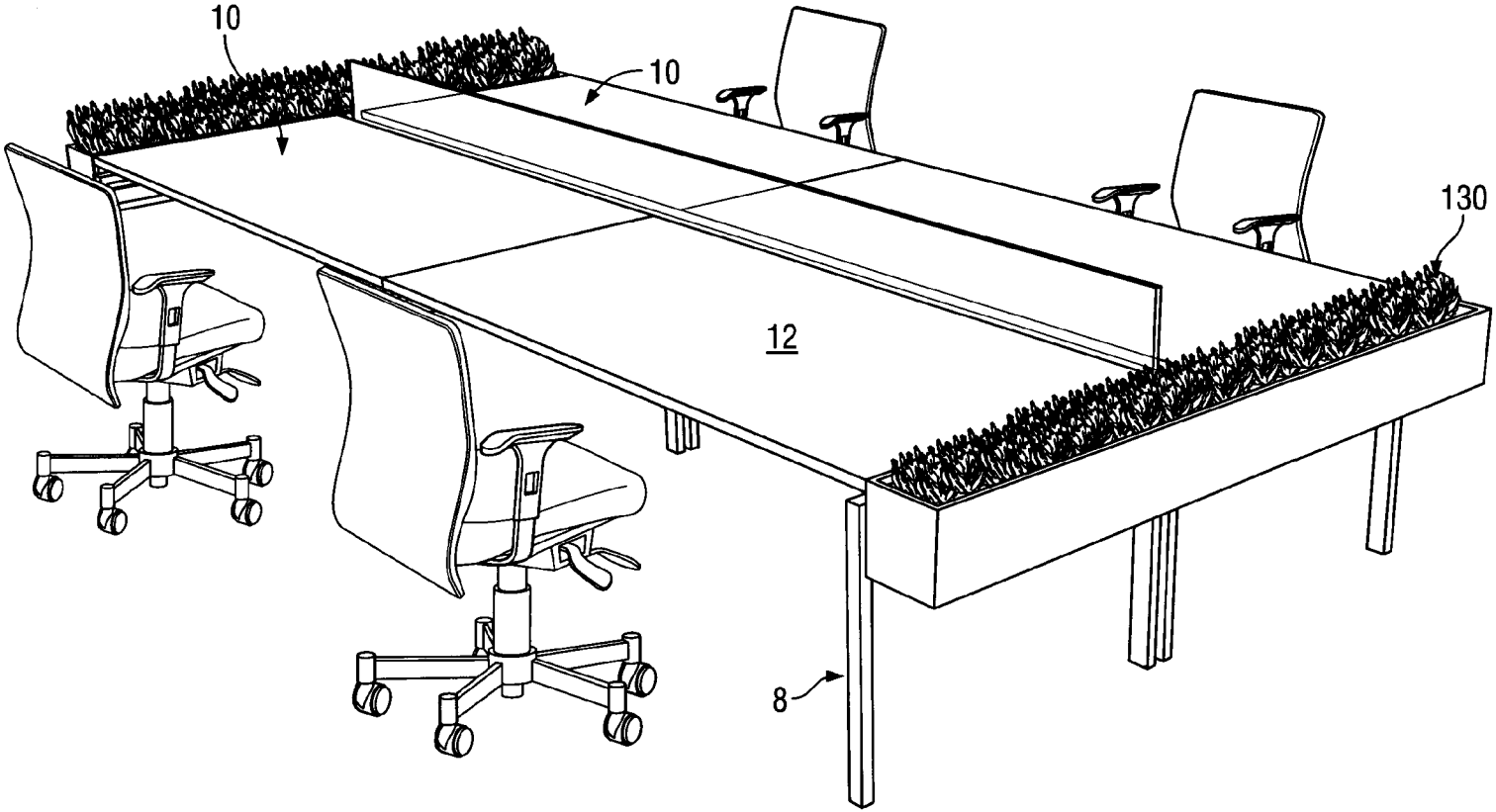
FIG. 17 is a perspective view of the tables in FIG. 1 with planters mounted across the ends of two tables.

FIG. 17 illustrates tables 10 as in FIG. 1 to which a planter 130 is mounted to the leg structures 8 at the end of the tables 10 and with the planter 130 having mounted on its rear hook members the same as that shown in FIG. 16 for engagement with the intermediate beam 50.

Figure 18:
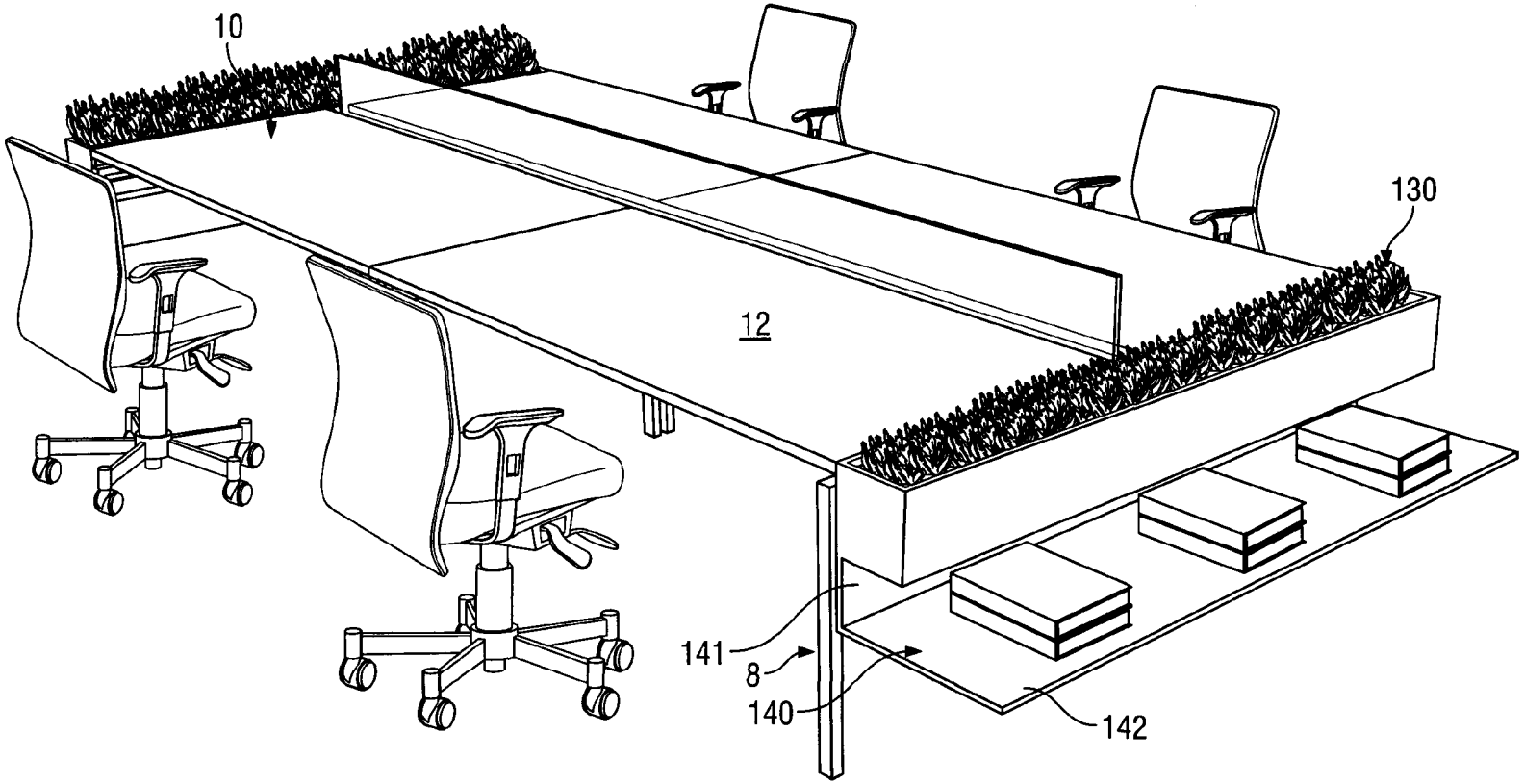
FIG. 18 is a pictorial view of the table in FIG. 17 additionally showing a shelf mounted to the ends of the tables underneath one planter.
Figure 19:
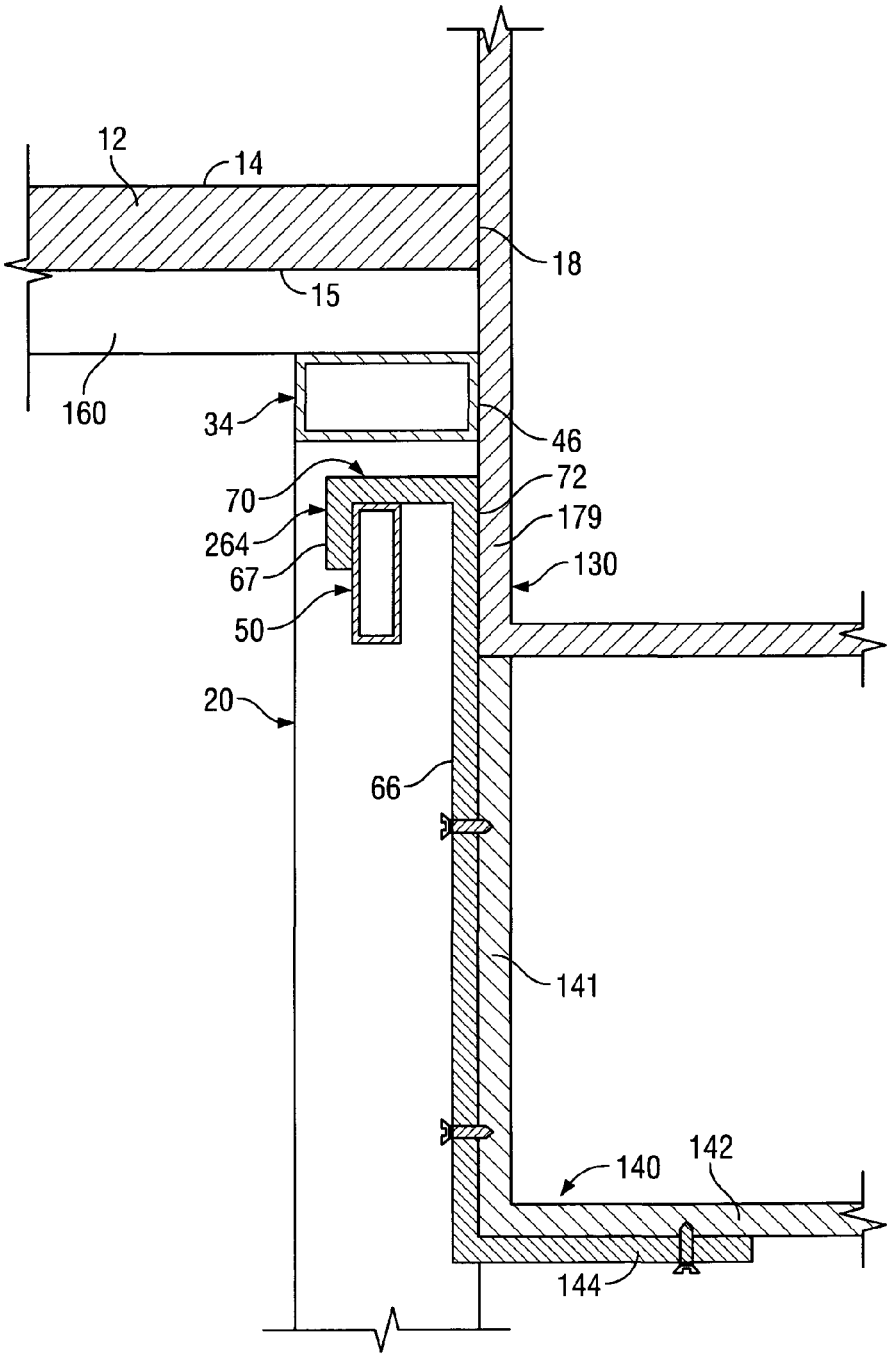
FIG. 19 is a schematic front cross-sectional view similar to FIG. 5 but through the planter and shelf of FIG. 17.

Reference is made to FIG. 18 which illustrates tables 10 to which a planter 130 is mounted in an identical manner to that described in FIG. 17, however, in which a shelf member 140 is also mounted underneath the planter 130. The shelf member 140 includes a vertical back panel 141 and a horizontal shelf panel 142 fixedly secured together. FIG. 19 is a partial front cross-sectional view through FIG. 18 similar to FIG. 5 and showing a hook member 256 which removably couples the shelf element 140 to the leg structure 8. As seen in FIG. 19, the hook member 256 is substantially the same as the hook member 164 shown in FIG. 13, however, the outer arm 66 is extended downwardly along the back panel 141 to horizontal support arm 144 which extends forwardly underneath the shelf panel 142. The outer arm 66 is secured to the rear panel 140 as by fasteners in a similar manner in that the hook member 164 is secured to the rear panel 125 of the cabinet 120 as seen in FIG. 16. The hook members 256 to support the bookshelf are to engage the intermediate beam 50 at locations spaced axially along the intermediate beam 50 from locations where brackets 156 which support the planter 130 are located on the intermediate beam 50. The shelf member 140 is first to be coupled to the leg assemblies 8 and thereafter the planter 130 may be coupled to the leg assemblies 8.

Figure 20:
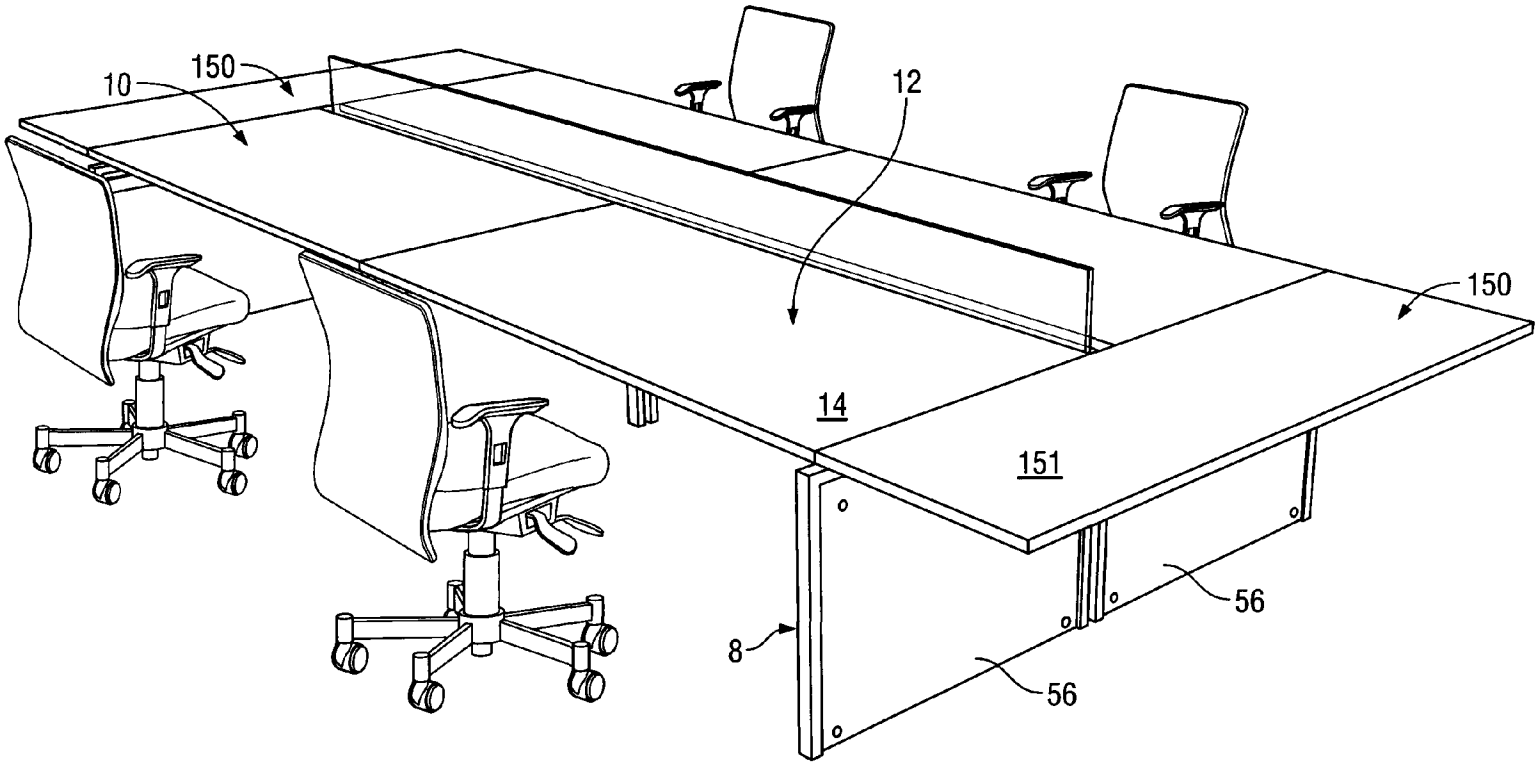
FIG. 20 is a pictorial view of the tables of FIG. 4 with an extension worksurface mounted at the ends of the tables.

Reference is made to FIG. 20 which illustrates the tables 10 of FIG. 1 to which a worksurface extension 150 is mounted with the worksurface extension 150 having an upper surface 151 which is flush with the upper surface 14 of the worksurface 12.

Figure 21:
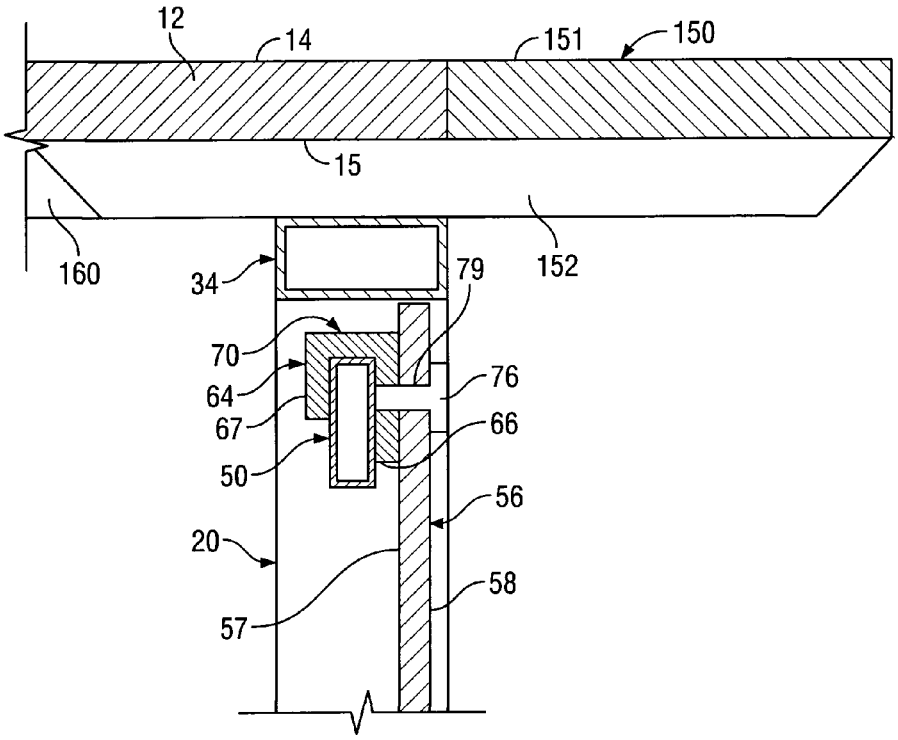
FIG. 21 is a schematic front cross-sectional view similar to FIG. 5 but through the tables and extension worksurface of FIG. 20.

FIG. 21 is a schematic partial front cross-sectional view of the embodiment of FIG. 20 similar to FIG. 5 and showing one manner in which the worksurface extension 150 may be mounted. As seen in FIGS. 1, 5 and 21, underneath the worksurface 12 and above the leg structure 8, there are provided a pair of longitudinally extending rails 160 which provide a rail space 161 between a top surface 99 of the upper beam 34 and the lower surface 15 of the worksurface. The rails 160 serve to rigidly connect the leg structures 20 and provide a rigid support for the worksurface 12 to which the worksurface 12 is preferably fixedly secured. The right end 19 of the worksurface 12 and an end 163 of the rails 160 are in the same common end plane as the outer surfaces 26 of the legs 20 and 21.

As seen in FIG. 21, an elongate support beam 152 is secured to the lower surface 16 of the worksurface 12 and extends beyond the end 18 of the table 10. The extension 150 sits on the support beam 152 and is secured thereto as by screws and the like.

Referring to FIG. 21, the support beam 152 extends through the rail space 161 above the upper beam 34. The space 44 between the upper beam 34 and the intermediate beam 50 remains open laterally outwardly such that independently of the extension worksurface 150 various elements may be supported on the leg structures 8 underneath the support beams 152. For example, in FIG. 20, privacy panels 56 as illustrated in FIG. 4 are shown as secured to the leg structures 8 by engagement with the intermediate beam 50 in the same manner as described with reference to FIG. 4. In a similar manner, for example, other elements such as the double hook member 100, the shelf member 140 and the storage cabinet 120 can be coupled to the leg assemblies 8 underneath the extension worksurface 150. In a similar manner, various elements may also be coupled to the leg structures 8 underneath the cabinet 170 as mounted and shown in FIG. 22.

Figure 22:
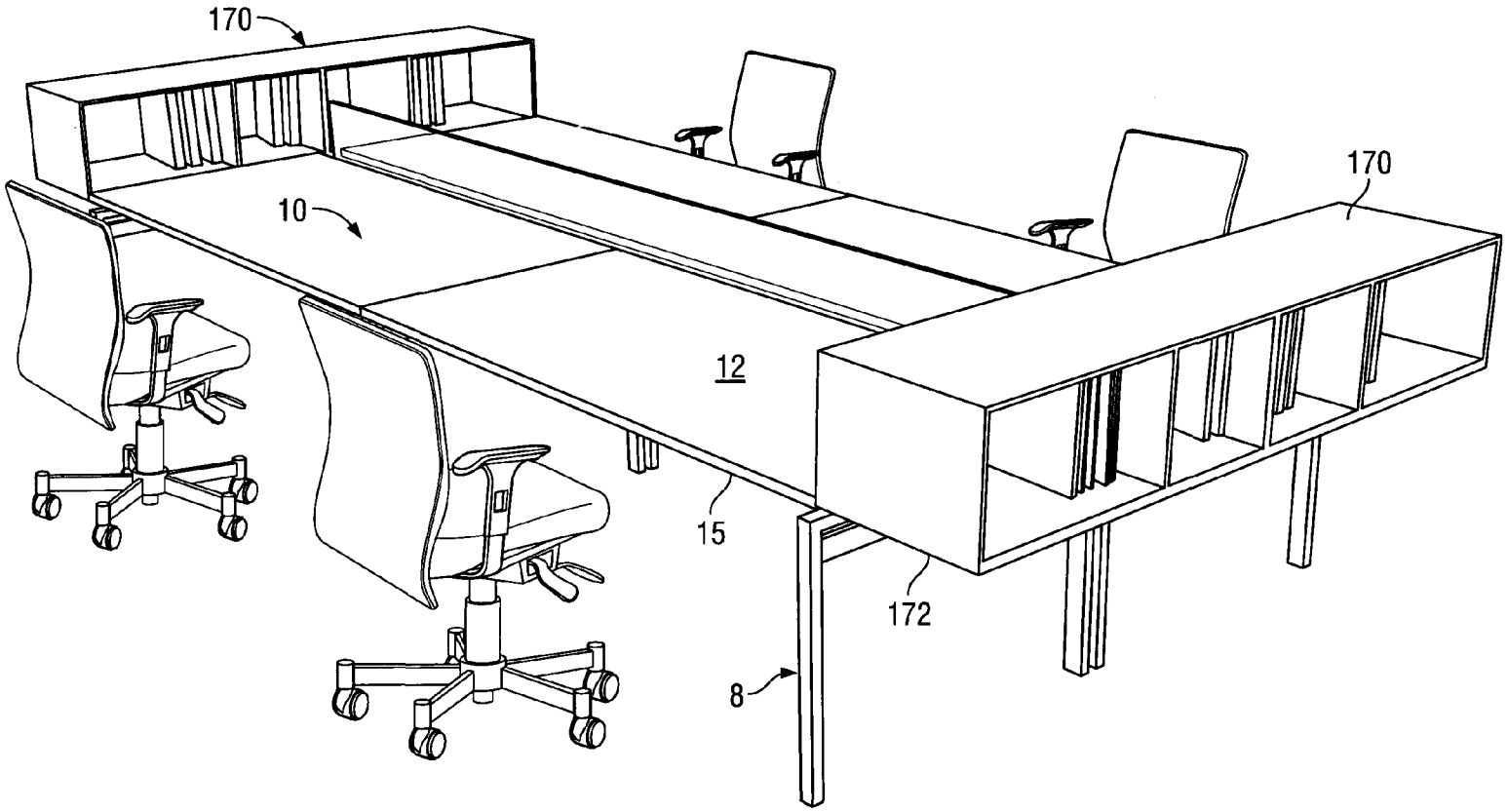
FIG. 22 is a pictorial view of the tables as in FIG. 1 with a storage bin mounted at the ends of the tables.

Reference is made to FIG. 22 which illustrates the tables 10 of FIG. 1 to which a cabinet 170 has been mounted. The cabinet 170 is similar to cabinet 120 but without a rear wall. The cabinet 170 is disposed such that the bottom panel 172 is in the same plane as the lower surface 15 of the worksurface 12 mounted on support beams 152 such as shown in FIG. 21.

Figure 23:
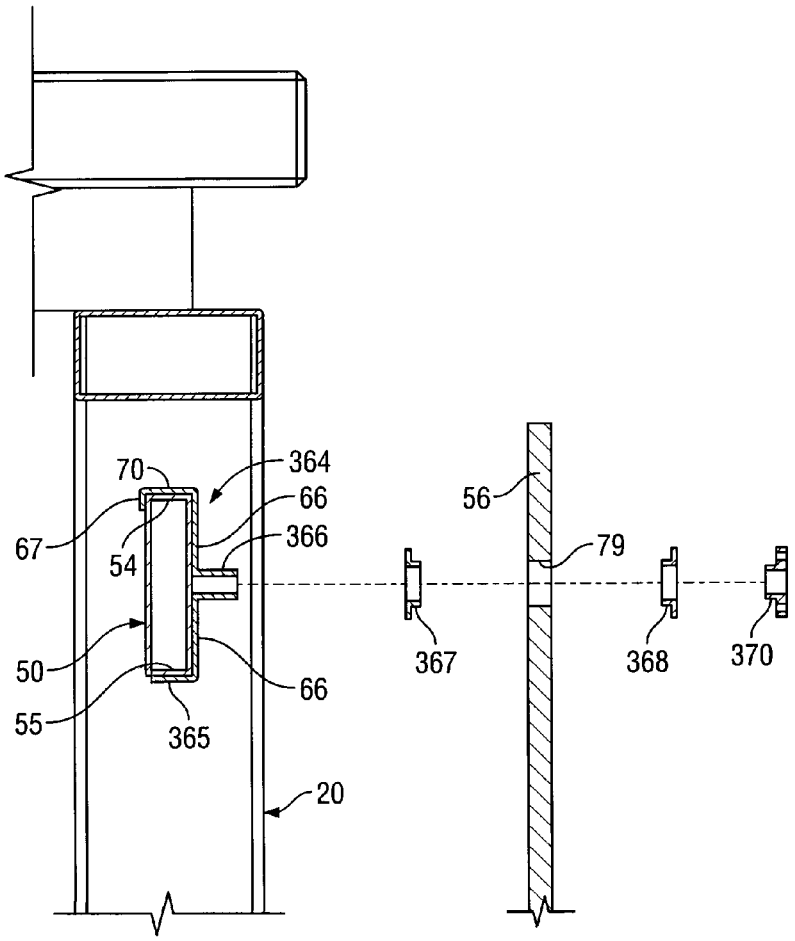
FIG. 23 is a cross-sectional front view similar to FIG. 5 but of another embodiment of the present invention.

Reference is made to FIG. 23 which shows as another embodiment of the present invention a modified structure for coupling the privacy panel 56 to the intermediate beam 50. In FIG. 23, the hook member 364 is provided which is generally C-shaped having in addition to the inner arm 67 bridge member 70 and the outer arm 66 a lower arm 365 which extends inwardly from the outer arm 66. The C-shaped bracket member 364 is adapted to be engaged onto the intermediate beam 50 in a snap-fit relation with the bridge member engaged on the top surface 54 of the intermediate beam 50 and the lower arm 365 engaged on the lower surface 55 of the beam member 50. The outer arm 66 carries a horizontally disposed outwardly extending tubular member 366 whose outer surface is threaded. The panel 56 has an opening 79 therethrough. An inner ferrule 367 and an outer ferrule 368 each extend into the opening 79 through the panel 56 from either side and a threaded nut 57 with an internally threaded inwardly directed bore engages onto the threaded stud tube 366 to draw and secure the panel 56 on the tube 366 sandwiched between the nut 70 and the outer portion 66 of the bracket.

In accordance with the present invention, FIG. 5 illustrates one arrangement of securing the lower end of the panel 56 to the bracket 80 by the use of threaded fastener 88. A threaded fastener in the lower opening 94 through the panel 56 may be eliminated and, for example, a simple connection being provided between the outer surface of the bracket and the inner face 57 of the panel as, for example, by the use of magnets or by the use of Velcro brand hook and eye fasteners.

While the invention has been described with reference to preferred embodiments, many modifications and variations will now occur to persons skilled in the art. For a definition of the invention, reference is made to the following claims.

The invention claimed is:

1. A table comprising: a tabletop worksurface, the table having an outer end, a leg structure supporting the tabletop under the outer end of the table, the leg structure comprising two spaced vertical legs comprising a right leg and a left leg, each leg having a top and a bottom, each leg having an outer end surface and an inner end surface, the outer surfaces of both legs lying in a common flat outer end plane, the inner surfaces of both legs lying in a common flat inner end plane parallel to the outer plane, each leg having an interior surface directed toward the other leg, an elongate horizontal upper beam extending between the legs proximate the top of the legs, the upper beam having two ends with each end joined to a respective one of the legs, the upper beam having a bottom surface directed downwardly, an elongate horizontal intermediate beam extending between the legs intermediate the top and bottom of the legs, the intermediate beam having two ends with each end joined to a respective one of the legs, the intermediate beam spaced below the upper beam forming a vertical space therebetween, the intermediate beam having an outer side surface and an inner side surface, the intermediate beam having a top surface, the outer side surface of the intermediate beam disposed inwardly of the outer end plane, a rectangular flat planar privacy panel having an outer face and an inner face joined by a top edge, a bottom edge, a right side edge, and a left side edge, the privacy panel disposed between the outer end plane and the inner end plane outwardly of the intermediate beam with the outer face of the panel directed away from the intermediate beam, the top edge below the upper beam, the right side edge adjacent the interior surface of the right leg and the left side edge adjacent the interior surface of the left leg, the panel mounted to the intermediate beam outwardly of the beam by at least one hook member removably mounted to the intermediate beam and extending rearwardly over the top surface of the intermediate beam and downwardly into engagement with the inner side surface of the intermediate beam.

2. A table as claimed in claim 1 wherein the hook member has an outer arm and an inner arm joined by a bight member, the outer arm extending from the bight member to a distal end of the outer arm, and the inner arm extending from the bight member to a distal end of the inner arm forming a blind slotway between the outer arm and the inner arm, the hook member removably engaged about the intermediate beam with intermediate beam within the slotway between the outer arm and the inner arm with the bight member engaging the top surface of the intermediate beam, the outer arm carrying an outwardly directed surface, the panel releasably secured to the hook member with the inner face of the panel in engagement with the outwardly directed surface of the outer arm.

3. A table as claimed in claim 2 wherein:

the outer arm carries an outwardly extending tubular member with a threaded outer surface, an upper opening extending through the panel, the tubular member extending through the upper opening in the panel, a threaded nut member threadably engaged on the tubular member outwardly of the panel to removably secure the panel to the hook member.

4. A table as claimed in claim 3 wherein the outer face of the panel is parallel to the outer end plane.

5. A table as claimed in claim 4 wherein the upper beam comprises an outer surface in the flat outer end plane.

6. A table as claimed in claim 2 including:

a right bracket member removably coupled to the right leg proximate the bottom of the right leg, the right bracket member presenting an outwardly directed outer surface in engagement with the inner face of the panel, and a left bracket member removably coupled to the left leg proximate the bottom of the left leg, the left bracket member presenting an outwardly directed outer surface in engagement with the inner face of the panel.

7. A table as claimed in claim 6 including:

wherein said at least one hook member is at least two hook members at spaced locations on the intermediate beam, the hook members comprising a right hook member proximate the right leg and a left hook member proximate the left leg, a threaded bore in the outer arm of each hook member, an upper right opening extending through the panel and an upper left opening extending through the panel, a fastener extending through the upper right opening in the panel and into the bore of the right hook member to removably secure the panel to the right hook member, and a fastener extending through the upper left opening in the panel and into the bore of the left hook member to removably secure the panel to the left hook member, the outward surface of the right bracket member having a threaded bore, a lower right opening through the panel, a fastener extending through the lower right opening in the panel and into the bore in the right bracket member to removably secure the panel to the right bracket member, the outward surface of the left bracket member having a threaded bore, a lower left opening through the panel, a fastener extending through the lower left opening in the panel and into the bore in the left bracket member to removably secure the panel to the left bracket member.

8. A table as claimed in claim 2 including a threaded bore in the outer arm, an upper opening extending through the panel, a fastener extending through the upper opening in the panel and into the bore to removably secure the panel to the hook member.

9. A table as claimed in claim 1 including wherein said at least one hook member is at least two hook members at spaced locations on the intermediate beam, the hook members comprising a right hook member proximate the right leg and a left hook member proximate the left leg.

10. A table as claimed in claim 9 wherein the outer face of the panel is parallel to the outer end plane.

11. A table as claimed in claim 9 wherein:

each outer arm carries a respective outwardly extending tubular member with a threaded outer surface, two upper opening extending through the panels, each tubular member extending through a respective of the upper openings in the panel, a pair of threaded nuts, each threaded nut threadably engaged on a respective of the tubular members to removably secure the panel to the hook members.

12. A table as claimed in claim 1 wherein the upper beam comprises an outer surface in the flat outer end plane.

13. A table as claimed in claim 1 wherein the outer face of the panel is parallel to the outer end plane.

* * * * *